US007451497B2

(12) United States Patent
von Blücher

(10) Patent No.: US 7,451,497 B2
(45) Date of Patent: Nov. 18, 2008

(54) PROTECTIVE HANDWEAR

(75) Inventor: Hasso von Blücher, Erkrath (DE)

(73) Assignee: Blücher GmbH, Erkrath (DE)

( * ) Notice: Subject to any disclaimer, the term of this patent is extended or adjusted under 35 U.S.C. 154(b) by 764 days.

(21) Appl. No.: 10/835,123

(22) Filed: Apr. 28, 2004

(65) Prior Publication Data

US 2005/0076418 A1 Apr. 14, 2005

(30) Foreign Application Priority Data

Oct. 14, 2003 (DE) ..... 103 48 470
Nov. 24, 2003 (DE) ..... 103 54 902

(51) Int. Cl.
*A41D 19/00* (2006.01)

(52) U.S. Cl. ..... 2/161.6; 442/122

(58) Field of Classification Search ..... 2/457, 2/158, 159, 161.6, 161.7, 164, 167, 901; 442/121, 122; 428/198
See application file for complete search history.

(56) References Cited

U.S. PATENT DOCUMENTS 3,586,596 A * 6/1971 Ainsworth et al. ..... 442/35
4,459,332 A * 7/1984 Giglia ..... 428/86
4,500,581 A 2/1985 Mitomi et al.
4,510,193 A * 4/1985 Blucher et al. ..... 428/196
4,515,761 A * 5/1985 Plotzker ..... 423/240 R
4,943,475 A * 7/1990 Baker et al. ..... 442/71
4,981,738 A * 1/1991 Farnworth et al. ..... 428/55
5,017,424 A * 5/1991 Farnworth et al. ..... 442/71
5,024,594 A * 6/1991 Athayde et al. ..... 442/67
5,273,814 A * 12/1993 Kelly ..... 442/16
5,453,314 A * 9/1995 Collier et al. ..... 428/198
5,614,301 A * 3/1997 Katz ..... 442/315
5,731,065 A 3/1998 Stelzmüller et al.
5,740,551 A * 4/1998 Walker ..... 2/16
5,743,775 A * 4/1998 Baurmeister ..... 442/77
6,134,718 A * 10/2000 Sesselmann ..... 2/243.1
6,301,715 B1 * 10/2001 Hoffmann ..... 2/161.8
6,591,427 B1 * 7/2003 Bennett ..... 2/161.8
6,662,377 B2 * 12/2003 Williams ..... 2/239

(Continued)

FOREIGN PATENT DOCUMENTS

DE 28 29 599 1/1980

(Continued)

*Primary Examiner*—Katherine Moran
(74) *Attorney, Agent, or Firm*—Cohen Pontani Lieberman & Pavane LLP

(57) ABSTRACT

A protective glove having a protective function against toxic chemical agents, especially chemical warfare agents, and a multilayer construction including a breathable layer is disclosed. The glove has a support layer and a barrier layer, which is assigned to the support layer and which faces the hand when the glove is worn, prevents or at least retards the passage of toxic chemical agents, and contains an adsorption layer based on an adsorbent material, such as activated carbon, which adsorbs toxic chemical agents. The barrier layer has, in addition to the adsorption layer, a membrane, which is at least preferably impermeable to water and air, but permeable to water vapor, and which retards the passage of toxic chemical agents or is at least essentially impermeable to toxic chemical agents. The membrane is arranged between the support layer and the adsorption layer. The protective glove has a high degree of wearing comfort with good tactility properties and at the same time provides excellent protection against toxic chemical agents.

42 Claims, 4 Drawing Sheets

U.S. PATENT DOCUMENTS

| | | | | |
|---|---|---|---|---|
| 6,718,555 | B2 * | 4/2004 | Hofmann | 2/159 |
| 6,740,406 | B2 * | 5/2004 | Hu et al. | 428/403 |
| 2004/0060102 | A1 | 4/2004 | Brookman | |
| 2005/0101211 | A1 * | 5/2005 | Ramkumar | 442/270 |
| 2005/0266749 | A1 * | 12/2005 | De Ruiter | 442/59 |

FOREIGN PATENT DOCUMENTS

| | | | |
|---|---|---|---|
| DE | 39 17 336 | | 11/1990 |
| DE | 39 39 373 | | 6/1991 |
| DE | 43 10 110 | | 1/1994 |
| DE | 195 19 869 | | 12/1996 |
| EP | 0 525 409 | | 2/1993 |
| EP | 526264 | A1 * | 2/1993 |
| FR | 2 752 994 | | 3/1998 |
| GB | 2 025 316 | | 1/1980 |
| WO | WO 93/25279 | | 12/1993 |

* cited by examiner

PROTECTIVE HANDWEAR

CROSS REFERENCE TO RELATED APPLICATION

This application claims priority based on German Patent Applications Serial No. 103 48 470.1, filed Oct. 14, 2003; and Serial No. 103 54 902.1, filed Nov. 24, 2003.

BACKGROUND OF THE INVENTION

1. Field of the Invention

The present invention relates to protective handwear, such as a glove, that is made at least in part of a breathable material, and which serves to protect against toxic chemicals, especially chemical warfare agents and nuclear, biological and chemical ("NBC") agents; and is intended especially for chemical warfare protective use by the military, and for general NBC protective use.

2. Description of the Related Art

There are a number of substances that are absorbed by the skin, the exposure to which results in severe physical damage. Examples are mustard gas usually contained in vessels marked with a yellow cross, which is a vesicant, and sarin, which is a nerve gas. Individuals who may come into contact with these toxic agents must wear suitable protective equipment or otherwise be protected against these toxic agents by suitable protective materials.

Suitable protective suits are available for protecting the body, especially the extremities and the trunk. To protect the head, especially the face, and the respiratory tract, gas masks (NBC protective masks), often together with hoods, are usually worn.

In addition, however, it is also important that the hands be adequately protected against these types of toxic agents, especially by the wearing of protective gloves. In particular, protective gloves of this type must be suitable for military chemical warfare protective use or for general NBC protective use.

In the state of the art with respect to military chemical warfare use and general NBC protective use, airtight and watertight rubber gloves, especially based on butyl rubber, are presently often used. These gloves are impermeable to toxic chemical agents, especially such as chemical warfare agents. A disadvantage of these protective gloves is their poor ability to breathe (i.e., permit the escape of water vapor generated from the wearer's perspiration) and thus they have a very low level of wearing comfort, which makes them uncomfortable and burdensome when worn for a long period of time.

U.S. Pat. No. 6,301,715 B1, of the same applicant, and WO 01/82,728 A1 and DE 201 21 518 U1, which belong to the same patent family, describe a glove for pilots with improved tactility and protective effect against toxic chemical agents, which consists of an outer material that is capable of breathing, such as leather or a textile material, and can be furnished with an adsorption layer based on activated carbon for adsorbing chemical warfare agents. Although the glove disclosed in the above mentioned patents offers excellent protection against toxic chemical agents, especially chemical warfare agents, when an adsorption layer, based on activated carbon is present, the wearing time of that glove in military or NBC protective use is limited due to the limited adsorption capacity of the activated carbon. Furthermore, that glove cannot be readily decontaminated or regenerated.

SUMMARY OF THE INVENTION

Therefore, the object of the present invention is to make available protective handwear such as a glove, especially a protective glove that is capable of breathing, which provides protection against toxic chemical agents, especially chemical warfare agents; is particularly suitable for military chemical warfare and general NBC protective use; and at least partially avoids the aforementioned disadvantages of protective handwear of the previous state of the art.

An additional object of the present invention is further development of the glove described in U.S. Pat. No. 6,301,715 B1 and in the two cited parallel patent applications WO 01/82,728 A1 and DE 201 21 518 U1, belonging to the same patent family.

To achieve the objects stated above, the present invention discloses protective handwear, such as a protective glove, especially a protective glove that is capable of breathing and is suitable for military and NBC use, in accordance with claim 1. Additional advantageous refinements of the protective glove of the invention are specified in the dependent claims.

In the following, reference is made generally to an embodiment of the present invention represented by a glove, however it is to be understood that this is done for convenience of description and that this is a non-limiting example, with the present invention being applicable to and encompassing other forms of protective handwear as well, such as, for example, a mitten.

Accordingly, the present invention provides a protective glove that is capable of breathing, which has a multilayer construction with a preferably flat, outer support layer and an inner barrier layer (i.e., on the inside of the glove nearest to the hand when the glove is worn), which is arranged adjacent to the support layer, and prevents or retards the passage of toxic chemical agents. The inner barrier layer contains an adsorption layer with an adsorbent material such as activated carbon, that adsorbs toxic chemical agents. In order to provide a further enhanced or improved protective function against toxic chemical agents, especially chemical warfare agents, the barrier layer is not only provided with the adsorption layer, but also with a membrane, which is arranged between the support layer and the adsorption layer. The membrane is at least substantially impermeable to air and liquid water, but is permeable to water vapor, and retards the passage of toxic chemical agents, or is at least substantially impermeable to toxic chemical agents.

The aforementioned membrane, which is arranged between the support layer and the adsorption layer, functions such that toxic chemical agents, especially chemical warfare agents, that may have penetrated the outer support layer, never reach the adsorption layer, or for the most part, do not reach the adsorption layer, so that the adsorption capacity of the adsorption layer remains substantially unexhausted. When the protective glove of the invention is provided with a special membrane that is capable of breathing and which membrane retards the passage of toxic chemical agents or is at least essentially impermeable to toxic chemical agents, good decontamination, regeneration and reusability of the glove of the invention are also possible.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

In the drawings.

DETAILED DESCRIPTION OF THE PRESENTLY PREFERRED EMBODIMENTS

Figure 1:
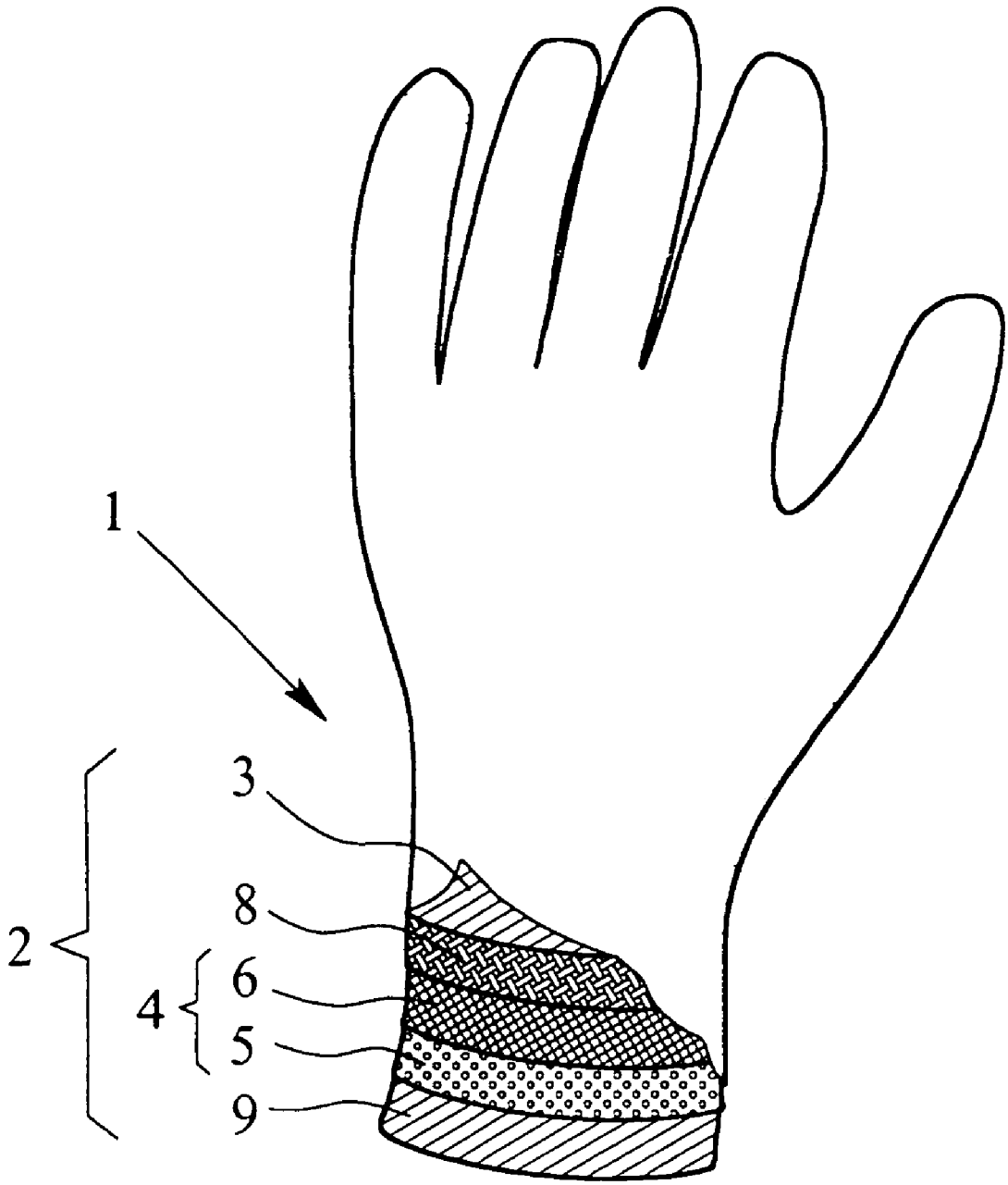
FIG. 1 is a schematic representation of a protective glove that is capable of breathing, in accordance with a preferred embodiment of the invention.

Referring to the drawings, FIG. 1 shows a glove 1 that is capable of breathing, in accordance with the invention, and which acts to protect against toxic chemical agents, especially chemical warfare agents. The protective glove 1 of the invention has a multilayer construction 2 with a preferably flat support layer 3 on the outside and a barrier layer 4 on the inside (i.e., the barrier layer is nearest to and facing the hand when the glove is worn), which is arranged next to the support layer 3, and which prevents or at least retards the passage of toxic chemical agents. The barrier layer 4 contains an adsorption layer 5, which is based on an adsorbent material, such as activated carbon, and which adsorbs toxic chemical agents. In addition to the adsorption layer 5, the barrier layer 4 includes a membrane 6, which is at least substantially impermeable to liquid water and air, but is permeable to water vapor (i.e., is capable of breathing), and which retards the passage of toxic chemical agents or is at least substantially impermeable to toxic chemical agents, and which is arranged between the support layer 3 and the adsorption layer 5. In accordance with the invention, the barrier layer 4 thus comprises both an adsorption layer 5 and a membrane 6 with the specified properties. The combination of an adsorption layer 5, and a membrane 6, in accordance with the layered construction 2 of the invention, ensures efficient protection against toxic chemical agents, especially chemical warfare agents, and at the same time provides a high degree of wearability and wearing comfort, especially as regards to breathability, by allowing internally generated water vapor, such as from perspiration of the wearer, to escape and not remain so as to cause the inside of the glove to become wet.

Figure 2A:
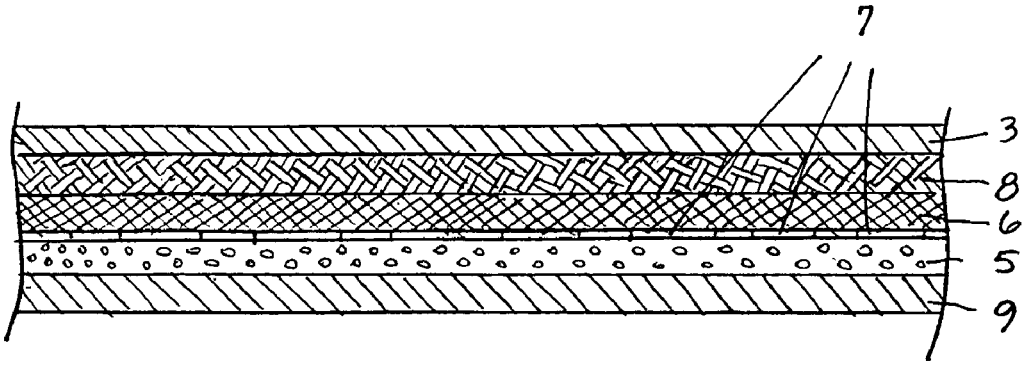
FIG. 2*a* shows a schematic cross section through the layered construction of a protective glove that is capable of breathing, in accordance with a preferred embodiment of the invention, wherein the adsorption layer is fixed on the membrane by discontinuous adhesive application.
Figure 2B:
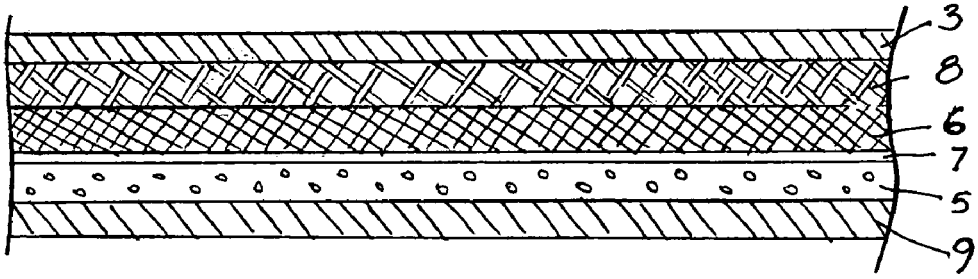
FIG. 2*b* shows a schematic cross section through the layered construction of a protective glove that is capable of breathing, in accordance with another preferred embodiment of the invention, wherein the adsorption layer is fixed on the membrane by continuous adhesive application.

As FIG. 1 and FIGS. 2*a* and 2*b* show, as a result of the arrangement of the several layers and materials, in accordance with the invention, such that the membrane 6 is between the support layer 3 and the adsorption layer 5, any toxic agents that may have penetrated the outer support layer 3 of the protective glove 1 are held back by the membrane 6 and thus do not reach the adsorption layer 5 at all or, at most, reach it only in extremely small amounts. Accordingly, the adsorption capacity of the adsorption layer remains substantially unexhausted, and, in addition, the presence of the membrane 6 provides additional protection for the person wearing the protective glove 1, so that a protective glove 1 with a dual protective function against toxic chemical agents is obtained due to the barrier effect of the membrane 6, and due to the adsorptive effect of the adsorption layer 5. The presence of the membrane 6 also makes it possible to decontaminate and regenerate the protective glove 1, since toxic agents that may have penetrated the outer layer 3 can be removed from the membrane 6 by suitable treatment methods (e.g., rinsing it off), for example, with decontamination solutions that are suitable for this purpose and are well known to persons of skill in the art.

Furthermore, an additional, preferably flat, support layer 8 may be placed between the membrane 6 and the support layer 3. In this embodiment, the membrane 6 is only indirectly adjacent to the support layer 3, with the additional support layer 8 being in between. The additional support layer 8 serves especially to stabilize and/or support the membrane 6, specifically, both during the treatment of the membrane 6, especially during the step of covering it with adhesive 7 and with the adsorption layer 5, and during the use or wearing of the glove. The wear resistance properties, e.g., the tear strength, of the membrane 6 can also be increased by the additional support layer 8. For this purpose, the membrane 6 can be laminated or bonded on the additional support layer, especially by means of an adhesive (not shown in the drawings), which is advantageously applied discontinuously (e.g., only in certain spots) over the surfaces being bonded, because this prevents excessive stiffness of the membrane 6, and in this way the wearing comfort of the glove is increased. The additional support layer 8, which is arranged between the membrane 6 and the outer support layer 3, can then be joined with the support layer 3, usually by means of an adhesive, which is preferably applied discontinuously, preferably in spots. Examples of materials that are suitable for the additional support layer 8 are textile materials, especially textile cloths, such as woven fabrics, hand-knitted fabrics, machine-knitted fabrics, layered fabrics, or bonded fabrics (e.g., non-woven fabrics), which are preferably designed to be air-permeable. It is advantageous for the additional support layer 8 to have a lower weight per unit area than the support layer 3. In general, the weight per unit area of the additional support layer 8 is less than 60 g/m$^2$, preferably less than 50 g/m$^2$, and more preferably less than 40 g/m$^2$. This contributes to greater wearing comfort, because the suppleness of the layered construction 2 as a whole is essentially unimpaired, and good wearability is achieved.

As described above, the membrane 6 is covered on an inside surface thereof (i.e., on the side facing the hand when the glove is worn) with an adsorption layer 5. The adsorption layer 5, in turn, may be provided, on a side thereof that faces the hand when the glove is worn (i.e., the side that faces away from the membrane 6), with a cover layer 9, which is advantageously fixed on the adsorption layer. The cover layer 9 can be fixed on the adsorption layer 5, for example, by adhesives, which for this purpose are preferably applied to the cover layer 9 discontinuously, especially in spots, or by so-called hot-melt adhesive webs, which are placed between the cover layer 9 and adsorption layer 5. Suitable materials for the cover layer 9 are preferably air-permeable textile materials, especially textile cloths, such as woven fabrics, hand-knitted fabrics, machine-knitted fabrics, layered fabrics, or bonded fabrics (e.g., nonwoven fabrics, especially polyamide/polyester (PA/PES) nonwoven fabrics). It is advantageous for the cover material 9 to be designed to be abrasion-resistant or to consist of an abrasion-resistant textile material. It is advantageous for the cover material 9 to have a weight of 5-150 g/m$^2$, preferably 10-125 g/m$^2$, and more preferably 40-100 g/m$^2$. The presence of the cover material or cover layer 9 has the advantage that direct contact of the skin or hand with the adsorption layer 5 is avoided when the glove is worn. This prevents the adsorption layer from being contaminated by sweat, and results in greater wearing comfort because the cover layer 9 assumes the function of a textile inner glove as part of the layered construction 2 of the invention. In addition, the cover layer 9 prevents excessive mechanical stress on the adsorption material of the adsorption layer.

As described above, the membrane 6 can be bonded (e.g., with adhesives), on its outer surface (i.e., on a side thereof that faces away from the hand when the glove is worn) either with the support layer 3 or with the additional support layer 8, depending on the design of the layered construction 2 of the invention. It is advantageous to perform the adhesive bonding only discontinuously, especially in spots and especially in the form of spot application in a grid or pattern, in which the adhesive covers only a maximum of 30% of the side of the membrane 6 that faces away from the hand when the glove is worn, preferably only a maximum of 25%, more preferably only a maximum of 20%, and most preferably only a maximum of 10%.

On an inside surface (i.e., on the side facing the hand when the glove is worn) of the membrane 6, the adsorption layer 5 is applied to the membrane 6, such as with the use of an adhesive 7. As described above, it is advantageous to apply the adhesive 7 discontinuously, especially only in spots, usually in the form of spot application in a grid. To achieve a high adsorption capacity, at least 50%, preferably at least 60%, more preferably at least 70%, still more preferably at least 75%, and most preferably at least 80% of the side of the membrane 6 that faces the hand when the glove is worn (i.e., on the side of the membrane 6 that faces away from the support layer 3), may be covered or loaded with the adsorbent material of the adsorption layer 5. Accordingly, the adhesive 7 must be applied over these surface areas of the membrane 6. If a cloth (woven fabric, knitted fabric, layered fabric, nonwoven fabric, etc.) made of activated carbon fibers is used as the adsorbent material of the adsorption layer 5, the side of the membrane 6 that faces the hand when the glove is worn (i.e., the side of the membrane 6 that faces away from the support layer 3), may be completely, (i.e., 100%), covered or loaded with the adsorbent material of the adsorption layer 5. The activated carbon fiber cloth may be fixed on the membrane, for example, by only discontinuous (e.g., spot wise) application of the adhesive.

In general, the individual layers 3, 4, 5, 6, 8, and 9 of the layered construction 2 are joined together. This is accomplished by methods that are already well known to persons of skill in the art (e.g., by adhesive bonding, heat sealing, sewing, stitching, etc.). It is advantageous to join or fix the individual layers 3, 4, 5, 6, 8 and 9 of the layered construction 2 seamlessly, preferably without damaging the individual layers 3, 4, 5, 6, 8, and 9 (e.g., by adhesive bonding, heat sealing, etc.). If the layers 3, 4, 5, 6, 8, and 9 are joined, at least partially, by sewing or similar methods, it is advisable to seal the seams (e.g., with so-called seam-sealing tape). In particular, the individual layers 3, 4, 5, 6, 8, and 9 of the layered construction 2 form a cohesive composite.

The individual layers 3, 4, 5, 6, 8, and 9 of the layered construction 2 may extend over the entire hand, including the wrist and part of the forearm (FIG. 1). In accordance with this embodiment, the individual layers 3, 4, 5, 6, 8, and 9 of the layered construction 2 forms a cohesive glove in the shape of a hand with five fingers, with palm, back of hand, and wrist portions, and an arm portion, which extends beyond the wrist.

It is advantageous to design the protective glove 1 in the form of a hand with five fingers, which is not only enhances the wearing comfort, but also facilitates use for military or NBC protective purposes. The fact that the glove 1 of the invention advantageously extends beyond the wrist (i.e., it has a glove arm section) allows a sealing connection with a simultaneously worn NBC protective suit. To this end, the glove and/or the NBC protective suit can be furnished with suitable sealing elements (e.g., zippers, Velcro fasteners, sealing lips, etc.) to seal the transition from the protective glove 1 to the NBC protective suit or to join them to each other to produce a sealed connection.

In particular, the individual layers 3, 4, 8, and 9 each has the shape of a glove with five fingers. The cover layer 9 forms an inner glove, while the support layer 3 forms an outer glove. The barrier layer 4 with the adsorption layer 5 on the inside and membrane 6 on the outside, together with the additional support layer 8, forms a core glove located between the inner glove and outer glove, and all three glove parts, i.e., the outer glove, inner glove, and core glove, are joined with one another and together form the protective glove 1 of the invention.

With respect to the material of the support layer 3, which in general forms the outer layer of the protective glove 1, any desired materials that are generally used for gloves may be used, especially those which are capable of breathing. Examples of such materials are textile materials, preferably air-permeable textile materials, especially in the form of textile cloths, such as woven fabrics, hand-knitted fabrics, machine-knitted fabrics, layered fabrics, and bonded fabrics. For example, the bonded fabric may be a nonwoven fabric. Alternatively, however, the support layer 3 may consist of a leather material. In this regard, it is advantageous to design the outer glove or the support layer 3 without seams in the region of the fingertips. For further details on this subject, see the previously cited documents U.S. Pat. No. 6,301,715 B1 and WO 01/82,728 A1 and DE 201 21 518 U1, the entire disclosed contents of which are hereby incorporated by reference in the present patent application.

To prevent or impede the penetration of toxic chemical agents (e.g., concentrated drops of chemical warfare agents), it is advisable to render the material of the outer support layer 3 oleophobic and/or hydrophobic, especially by a special impregnation.

The material of the support layer 3 or of the outer glove generally has a weight per unit area of 50-300 g/m$^2$, preferably 75-250 g/m$^2$, and more preferably 75-175 g/m$^2$. In particular, the support layer 3 is designed as an air-permeable textile cloth with a weight per unit area of 75-250 g/m$^2$, and preferably 75-175 g/m$^2$, which may be rendered oleophobic and/or hydrophobic.

With respect to the membrane 6, it is generally a continuous, especially closed, or at most, microporous membrane. The thickness of the membrane 6 is generally 1-500 μm, preferably 1-250 μm, more preferably 1-100 μm, still more preferably 1-50 μm, yet still more preferably 2.5-30 μm, and most preferably 5-25 μm. To enhance the wearing comfort, especially the breathability, the membrane 6 has a high water vapor permeability at 25° C. and a thickness of 50 μm, of at least 12.5 L/m$^2$ per 24 hours, preferably at least 17.5 L/m$^2$ per 24 hours, and especially at least 20 L/m$^2$ per 24 hours or more (measured by the inverted cup method in accordance with ASTM E 96 at 25° C.). (For further details on the measurement of water vapor transmission (WVT), reference is made to McCullough et al., "A comparison of standard methods for measuring water vapor permeability of fabrics" in *Meas. Sci. Technol.* [Measurement Science and Technology], Vol. 14, pp. 1,402-1,408, August 2003.) This ensures an especially high degree of wearing comfort.

Due to the large number of layers 3, 4, 5, 6, 8, and 9 of the layered construction 2, the water vapor permeability of the protective glove 1 as a whole is slightly lower than that of the membrane 6 alone. Nevertheless, the water vapor permeability of the protective glove 1 as a whole is very high and is at least 10 L/m$^2$ per 24 hours, preferably at least 15 L/m$^2$ per 24 hours, and more preferably at least 20 L/m$^2$ per 24 hours, at a thickness of the membrane 6 of 50 μm (at 25° C.).

For purposes of breathability, under steady-state conditions at 35° C. and a thickness of 50 μm, the membrane 6 should have a low water-vapor resistance $R_{et}$ of a maximum of 30 (m$^2$·pascal)/watt, preferably a maximum of 25 (m$^2$·pascal)/watt, and especially a maximum of 20 (m$^2$·pascal)/watt (measured by DIN EN 31 092:1993, as of February 1994 ("Textiles—Physiological Effects—Measurement of thermal and water-vapor resistance under steady-state conditions (sweating guarded-hotplate test)") or by the parallel international standard ISO 11 092).

Due to the large number of layers 3, 4, 5, 6, 8, and 9 of the layered construction 2, the water vapor resistance Ret of the protective glove 1 as a whole is slightly higher than that of the membrane 6 alone. The water vapor resistance $R_{et}$ of the glove 1 as a whole is generally a maximum of 30 (m$^2$·pascal)/watt, preferably a maximum of 25 (m$^2$·pascal)/watt, and more preferably a maximum of 20 (m$^2$·pascal)/watt, at a thickness of the membrane 6 of 50 μm.

In addition, the membrane 6 should be capable, at most, of swelling or absorbing water only slightly; a slight ability to absorb water or swell enhances the wearing comfort. In particular, the swelling capacity and/or the water absorption capacity of the membrane 6 should be a maximum of 35%, preferably a maximum of 25%, and more preferably a maximum of 20%, based on the weight of the membrane 6 itself. In addition, the membrane 6 should be at least substantially impermeable to liquids, especially water, and/or to aerosols, or it should at least retard their passage. To achieve a swelling capacity that is at most very low, the membrane 6 should have no or substantially no strongly hydrophilic groups, especially no hydroxyl groups. However, for purposes of slight swelling, the membrane 6 may have weakly hydrophilic groups, for example, polyether groups.

The membrane 6 may consist of or contain a plastic or a polymer material. A suitable plastic or polymer of this type may be selected, for example, from the group consisting of polyurethanes, polyether amides, polyester amides, polytetrafluoroethylenes, polymers based on cellulose, and derivatives of these compounds. For example, the membrane 6 may be obtained as the reaction product of the reaction of an isocyanate, especially a masked or blocked isocyanate, with an isocyanate-reactive crosslinking agent. Thus, the membrane 6 may be, for example, a polyurethane-based membrane. Similarly, the membrane 6 may also be an expanded, possibly microporous, membrane based on polytetrafluoroethylene.

Figure 3:
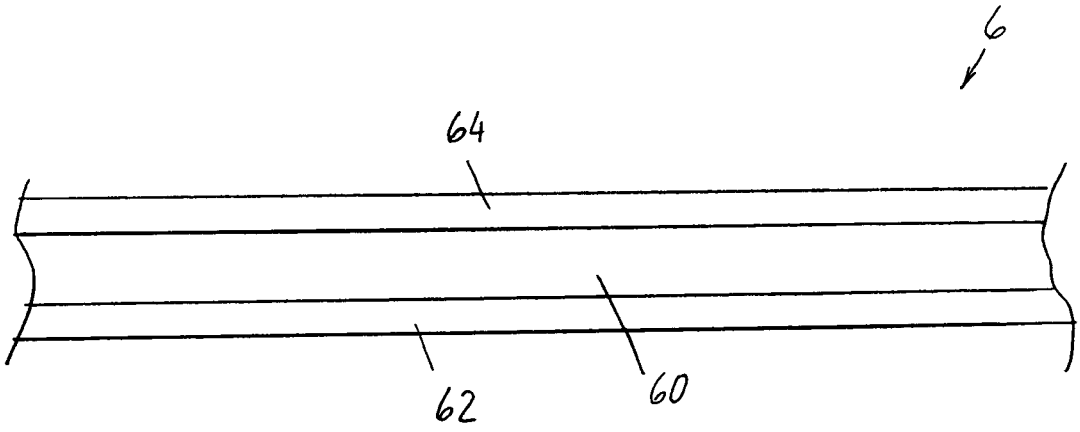
FIG. 3 shows a schematic cross section through a membrane laminate having a core layer and two outer layers.

In accordance with one preferred embodiment, the membrane 6 may be formed as a multilayer membrane laminate or as a multilayer membrane composite. This membrane laminate or composite may have at least two, and preferably at least three, membrane layers or membrane plies bonded together. For example, FIG. 3 shows a membrane laminate or composite having a core layer 60, which is made from a cellulose-based polymer and is bonded to two outer layers 62,64 which are preferably made of polyurethane, a polyether amide, and/or a polyester amide. In this regard, the core layer, made of a cellulose-based polymer, may be formed as a membrane with a thickness of 1-100 μm, preferably 5-50 μm, and more preferably 10-20 μm, and each of the two outer layers bonded to the core layer may be formed as a membrane with a thickness of 1-100 μm, preferably 5-50 μm, and more preferably 5-10 μm. This feature of the membrane 6 makes it possible to combine different membrane materials, each with different properties, especially different water vapor permeabilities and/or barrier effects with respect to toxic chemical agents, and thus to optimize the properties of the membrane 6. For example, cellulose and cellulose derivatives are excellent barrier layer materials, especially towards noxious and toxic chemical substances, such as chemical warfare agents (mustard gas, etc.), and are not attacked or dissolved by these materials, while polyurethane-based materials prevent the migration or diffusion of the plasticizers that may be present in the cellulose layer and, in addition, dampen the crackling noise caused by the cellulose when the glove is worn. Therefore, in accordance with this embodiment, it is preferred, in the case of a membrane laminate or composite, for the core layer to be formed of a polymer based on cellulose, and for the two outer layers of the membrane 6 to be formed by polyurethane layers.

As was previously described, the membrane 6 may be applied or bonded to an additional support layer 8, to increase the stability or wear resistance, and especially the tear strength, of the membrane 6 during the manufacturing process (e.g., when applying hot adhesive 7 to the membrane 6, as well as during the wearing of the glove.

To enhance the wearing comfort, and to achieve good wear resistance, it is advantageous that the membrane 6 has a certain elasticity. In particular, it is advantageous, that the membrane 6 can be elongated or stretched at least in one direction by at least 10%, preferably at least 20%, and more preferably at least 30% or more (with respect to the membrane 6). For purposes of the present invention, the layered construction 2 as a whole should have not only good suppleness, but also a certain elasticity; however, compared to the elasticity of the membrane 6, the elasticity of the layered construction 2 as a whole is somewhat lower, and, in general, the layered construction 2 as a whole should be capable of being elongated or stretched at least in one direction by at least 5%, preferably at least 10% and more preferably by at least 15% or more.

In accordance with another preferred embodiment, which is not shown in the drawings, the membrane 6 may simultaneously constitute the adhesive layer 7 for bonding the adsorption layer 5. In this case, the membrane 6 must be designed to be self-adhesive, especially so as to become adhesive on heating. In accordance with this embodiment, weight savings are achieved, since an entire additional layer, (i.e., of adhesive 7) is thereby completely eliminated.

Figure 4:
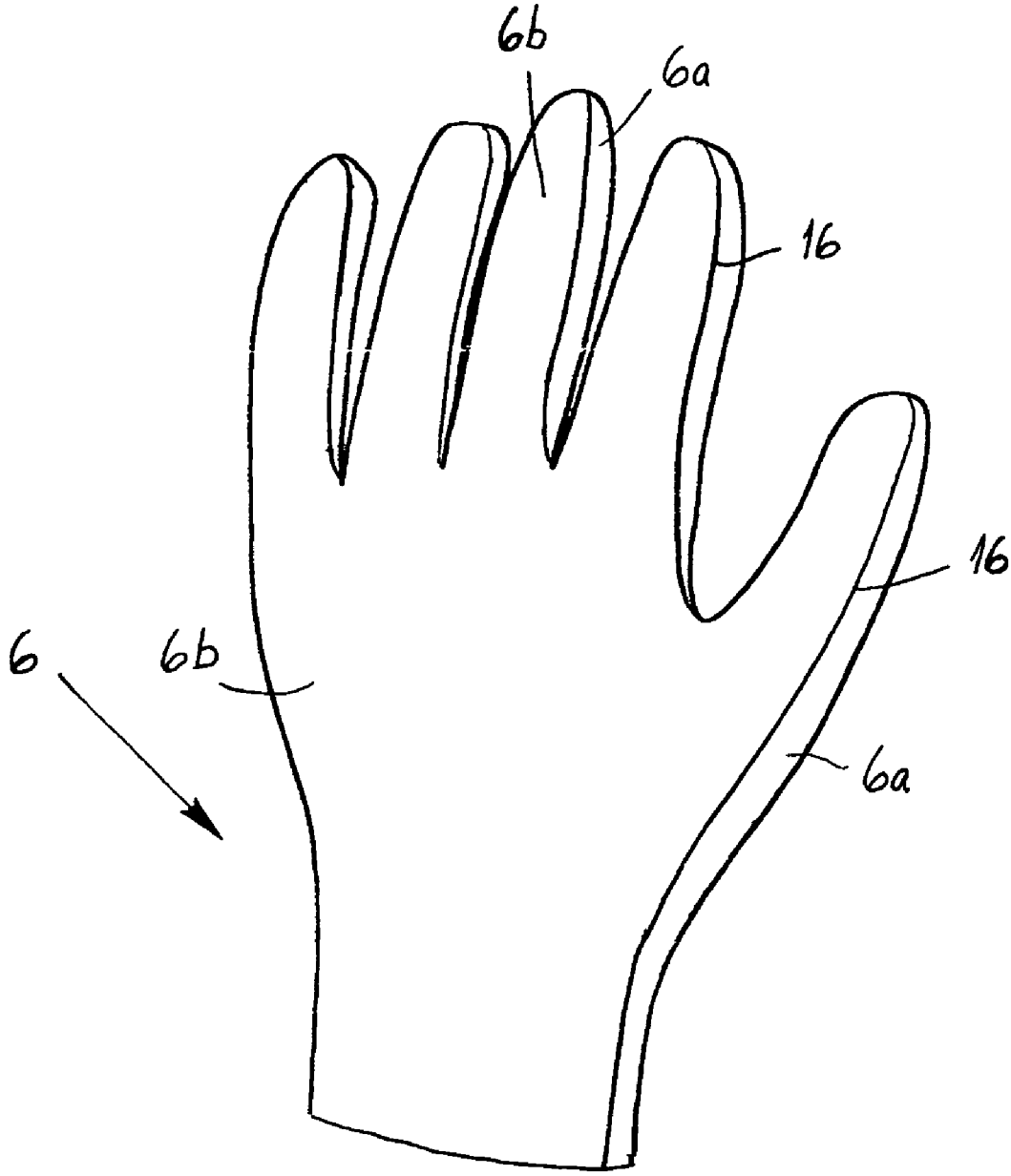
FIG. 4 is a schematic representation of the membrane layer of the glove of FIG. 1.

With respect to the construction of the protective glove 1 of the invention, FIG. 4 shows that the membrane 6 of the protective glove 1 generally consists of two pieces of material 6*a*, 6*b* that are joined together and are preferably bonded together to form a sealed structure, especially such as by adhesive bonding and/or heat sealing. In this regard, each of the two pieces of material 6*a*, 6*b* has the shape of a hand with five fingers, such that one of the two pieces of material is designed to cover the ventral side of the hand (the palm of the hand), and the other piece of material is designed to cover the dorsal side of the hand (the back of the hand), and the two pieces of material are joined together and preferably bonded together to form a sealed structure, especially by adhesive bonding and/or heat sealing, only along their outer contours 16, especially along the outline of the hand.

With respect to the adsorption layer 5 of the protective glove 1 of the invention, it is generally discontinuously formed, i.e., the adsorption layer 5 generally comprises discrete particles of adsorbent (e.g., based on activated carbon) that adsorb toxic chemical agents and can be fixed on the membrane 6, for example, by an adhesive 7. The adsorbent material of the adsorption layer 5 is preferably a material based on activated carbon, which contains or consists of activated carbon in the form of activated carbon particles and/or activated carbon fibers.

If materials that contain activated carbon are used as the adsorbent material for forming the adsorption layer 5, the high degree of wearing comfort that already exists can be further enhanced, because the activated carbon acts as an intermediate store for moisture and water (e.g., for sweat) and can act as a "buffer" against moisture and water. If, for example, activated carbon pellets are used as the adsorbent material for the adsorption layer 5, coverage of up to 250 g/m$^2$ or more is typical, so that, for example, in the event of heavy sweating, about 40 g/m$^2$ of moisture can be stored, which, in the case of a support or outer layer 3 that is breathable, again can be released to the outside.

In accordance with one embodiment of the present invention, the adsorption layer 5 is made from discrete particles of activated carbon, preferably in granular form ("granular carbon" or "spherical carbon"). In this case, the mean diameter of the particles of activated carbon should be less than 1.0 mm, preferably less than 0.5 mm, more preferably less than 0.4 mm, and most preferably less than 0.35 mm; however, the mean diameter of the activated carbon particles is generally at least 0.1 mm. In this embodiment, the particles of activated carbon are generally applied to the membrane 6 in amounts of 5-500 g/m$^2$, preferably 20-300 g/m$^2$, more preferably 25-250 g/m$^2$, and most preferably 50-120 g/m$^2$. Suitable activated carbon particles have a specific surface (BET) of at least 800 m$^2$/g, preferably at least 900 m$^2$/g, more preferably at least 1,000 m$^2$/g, and most preferably in the range of 800 to 1,500 m$^2$/g. Granular carbon, especially spherical carbon, has the advantage that it is extremely abrasion-resistant and very hard, which is important in regard to wear properties. The bursting pressure for an individual activated carbon particle, especially an activated carbon granule or spherule, is preferably at least about 5 newtons, more preferably at least about 10 newtons, and most preferably may reach as high as about 20 newtons.

In accordance with an alternative embodiment of the present invention, the adsorbent material of the adsorption layer 5 may consist of activated carbon fibers, especially in the form of activated carbon cloths. Activated carbon fiber cloths of this type may have, for example, weights of 20-200 g/m$^2$, preferably 30-150 g/m$^2$ and most preferably 50-120 g/m$^2$. These activated carbon fiber cloths may be, for example, activated carbon fiber woven fabrics, knitted fabrics, layered fabrics, bonded fabrics, or nonwovens (e.g., based on carbonized and activated cellulose and/or carbonized and activated acrylonitriles).

Similarly, it is also possible to combine activated carbon particles and activated carbon fibers with each other as the adsorbent material of the adsorption layer 5. Activated carbon particles have the advantage of a higher adsorption capacity, while activated carbon fibers exhibit better adsorption kinetics.

To increase the adsorption efficiency or adsorption capacity, it is also possible to impregnate the adsorbent material of the adsorption layer 5, especially the activated carbon particles and/or activated carbon fibers, with at least one catalyst. Examples of catalysts that are suitable in accordance with the invention are enzymes and/or metal ions, preferably copper, silver, cadmium, platinum, palladium, zinc, and/or mercury ions. The amount of catalyst may vary within wide ranges; in general, the amount of catalyst is 0.05 to 12 wt. %, preferably 1-10 wt. % and more preferably 2-8 wt. %, based on the weight of the adsorption layer 5.

To achieve an efficient adsorption capacity, it is preferred that at least 50%, more preferably at least 60%, and most preferably at least 70% of the adsorption layer 5 or the adsorbent material of the adsorption layer 5 be freely accessible to the toxic agents or chemical warfare agents to be adsorbed, i.e., that the adsorbent material of the adsorption layer not be covered with adhesive 7. This is accomplished by planning the amount and type of adhesive 7 and especially its viscosity in such a way that the adsorbent material of the adsorption layer is not completely pressed into the adhesive 7 or does not completely sink into the adhesive 7.

A typical protective glove 1 in accordance with the present invention includes, for example, the following layers: the support layer 3 ("outer glove") made, for example, of a sturdy type of fiber, preferably of a material having very low flammability, and preferably realized in seamless circular-knit form; the cover layer 9 ("inner glove") made of materials that are comfortable to wear against the skin such as rayon, PA, PES, m-aramid), preferably in flame retardant form (i.e. made flame retardant by treatment with a flame retardant), and preferably realized in seamless circular-knit form. The barrier layer 4, which is arranged between the inner and outer glove, may contain, in addition to the membrane 6, activated carbon spherules and/or fibers to form the adsorption layer 5 for adsorbing noxious or toxic substances.

The protective glove 1 of the invention provides efficient protection from toxic chemical agents, especially chemical warfare agents, and at the same time a high degree of wearing comfort, especially good breathability. One significant advantage of the protective glove 1 in accordance with the present invention is that the protective function against toxic chemical agents is integrated in the protective glove 1 itself, and no additional item of equipment is necessary. This not only results in considerable weight savings and increased wearing comfort, but also results in the possibility of achieving an efficient sealing connection between the protective glove and an NBC protective suit, so that toxic chemical agents, e.g., chemical warfare agents, cannot pass through or cannot readily pass through the transition region between the protective glove and protective suit. Due to these properties, the protective glove 1 in accordance with the present invention is suitable especially for military or civilian NBC protective use (e.g., in the form of a military protective glove or NBC protective glove).

Due to the high degree of efficiency of the protective function of the adsorption layer 5, which is increased by the further use, in accordance with the invention, of a membrane 6, it is also possible to use outer glove materials that are breathable e.g., leather or textiles, so that the wearing comfort of the sleeve is further increased in this way without exposing the wearer of the protective glove 1 to increased risk by the use of an outer glove material that is breathable, as would be the case when using a glove without the protection of the adsorption layer.

The high degree of flexibility or good suppleness of the individual layers 3, 4, 5, 6, 8, and 9, and of the layered construction 2 as a whole results not only in a high degree of wearing comfort, but also in good wear resistance of the protective glove 1 of the invention, while also maintaining good tactility.

The design in accordance with the invention of the protective glove 1 of the present invention achieves an excellent barrier effect against chemical warfare agents. The barrier effect of the protective glove 1, and particularly of the membrane 6, against chemical warfare agents, especially bis(2-chloroethyl)sulfide (synonymously known as mustard gas, usually contained in vessels marked with a yellow cross), as measured by CRDEC-SP-84010, Method 2.2, is a maximum of 4 $\mu g/cm^2$ per 24 hours, preferably a maximum of 3.5 $\mu g/cm^2$ per 24 hours, more preferably a maximum of 3.0 $\mu g/cm^2$ per 24 hours, and most preferably a maximum of 2.5 $\mu g/cm^2$ per 24 hours, at a thickness of the membrane 6 of 50 μm.

The protective glove 1 of the invention can be manufactured by methods that are well known to persons of skill in the art.

For example, the following procedure may be followed in the manufacture of a glove of the invention: a membrane 6 from 50-100 μm thick can be laminated or bonded by spot application of an adhesive to a support layer 8, which serves to reinforce and stabilize the membrane. The membrane 6, which, for example, may be a polyurethane membrane, is then covered on its side facing away from the support layer 8 with a water vapor-permeable adhesive 7 in the form of a grid of spots, onto which activated carbon spherules are then applied while the adhesive 7 is still in a bondable state, to form the adsorption layer 5. The adhesive 7 may then be allowed to dry and/or cure. Two pieces of the material produced in this way are then cut out in the form of a hand with five fingers and are adhesively bonded or heat-sealed along the outline of the hand (with the membranes 6 of each piece facing the inside), so that a barrier layer 4 in accordance with the invention is obtained in the form of a membrane glove covered with activated carbon. The adsorption layer 5 is covered on the inside with a cover material 9 in the form of an inner glove, for example, by adhesive bonding with a hot-melt adhesive web. This can be accomplished, for example, by putting the inner glove over a metal core in the form of a hand with five fingers and then covering it with the hot-melt adhesive web. The previously produced membrane glove is then placed over the inner glove. The outer surface of the support layer 8 is then bonded (e.g., by the technique described above) to the support layer 3 in the form of an outer glove, so that, finally, a protective glove 1 in accordance with the invention is obtained, which has a cover layer 9 as the inner glove, an outer support layer 3 as the outer glove, and a barrier layer 4, which is arranged between the inner glove and the outer glove, which consists of the adsorption layer 5 and the membrane 6, and, together with the additional stabilizing layer 8 for the membrane 6, forms a core glove or middle glove, such that the individual layers 3, 4, and 9 are joined together.

In accordance with a typical embodiment, a three-layer protective glove 1 in accordance with the present invention has the following composition:

a. the support layer 3 ("outer glove") made, for example, of a sturdy type of fiber, preferably also having very low flammability, which is preferably realized in seamless circular-knit form;

b. the cover layer 9 ("inner glove") made of materials that are comfortable to wear against the skin such as rayon, PA, PES, and m-aramid, are preferably in nonflammable form, and preferably realized in seamless circular-knit form;

c. the barrier layer 4 ("functional layer"), which is arranged between the inner and outer glove, made from, in addition to the membrane 6, activated carbon granules and/or fibers, to form the adsorption layer 5 for adsorbing noxious or toxic substances and which may be produced in various alternative forms, as described below:

(I) activated carbon granules are applied on a membrane layer 6 that is breathable (e.g., made of PU, PES, PA, PTFE, cellulose, etc.). The layer can be produced and the granules applied by immersion or by standard coating and covering processes. If a coated foil is produced as an intermediate step, it is converted to a two-dimensional or three-dimensional shape of a hand by suitable methods (e.g., adhesive bonding, sewing, heat sealing, etc.). The functional layer can be reinforced in the coating or on the side opposite the activated carbon granules by means of a network or knit of thermoplastic fibers;

(II) the functional layer consists of a hand-shaped knit of activated carbon fibers produced by carbonization of a corresponding glove made of rayon or polyacrylonitrile fibers, followed by activation, or knitted from the activated carbon fibers produced by suitable means;

(III) activated carbon flocks may also be applied by conventional flocking techniques to the breathable membrane layer in accordance with (I) instead of or in addition to the carbon granules;

(IV) the carbon granules and/or fibers are applied to a seamless or sewn inner glove in accordance with (b); and (V) a seamless or heat-sealed membrane glove (e.g., loose or bonding) can be placed as a liquid barrier over the functional layers in accordance with (II) or (IV).

The individual layers specified above (inner glove, functional layer, and outer glove) are put together and are joined with one another at the end of the arm, e.g., by a seam. In addition, if necessary, the layers are also fixed on the upper sides of the fingers and the backs of the hands by adhesives (e.g., by hot-melt adhesives, e.g., with thermal activation of the adhesive), double-sided strips of adhesive tape, Velcro fasteners or the like.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. Protective handwear with a protective function against toxic chemical agents, said protective handwear having a multilayer construction, at least a part of which is breathable in that it is selectively able to allow passage therethrough of certain substances, said protective handwear comprising:

a.) an outer support layer, which is farthest from a hand of a wearer when the protective handwear is being worn; and b.) an inner barrier layer, which is at least partially resistant to the passage of toxic chemical agents therethrough, and which is arranged adjacent to said outer support layer, such that said inner barrier layer is nearest to the hand of the wearer when the protective handwear is being worn;

said inner barrier layer comprising:

i.) an adsorption layer, containing an adsorbent material, capable of adsorbing toxic chemical agents; and ii.) a membrane, which is at least partially impermeable to the passage of air, liquid water, and toxic chemical agents therethrough, and which is at least partially permeable to the passage of water vapor therethrough, wherein said membrane is arranged between said outer support layer and said adsorption layer so that a side of said membrane facing the hand of the wearer is covered by said adsorption layer; and c.) a second support layer arranged between said membrane and said outer support layer, said second support layer comprising a textile material having a lower weight per unit area than said outer support layer and being joined to said membrane by a discontinuously applied adhesive so that said membrane is supported and stabilized by said second support layer.

2. protective handwear according to claim 1, wherein said adsorbent material of said adsorption layer is activated carbon.

3. The protective handwear according to claim 2, wherein said activated carbon is discontinuously formed and is in a form selected from the group consisting of: particles and fibers.

4. The protective handwear according to claim 3, wherein when said activated carbon is in the form of particles, said particles are in a shape selected from the group consisting of: granular; and spherical.

5. The protective handwear according to claim 1, wherein said membrane and said adsorption layer are joined together by an adhesive.

6. The protective handwear according to claim 1, wherein said second support layer is an air-permeable textile material selected from the group consisting of: a woven fabric; a hand-knitted fabric; a machine-knitted fabric; a layered fabric; a bonded fabric; and a nonwoven fabric.

7. The protective handwear according to claim 1, wherein the weight per unit area of said second support layer is less than 60 g/m$^2$.

8. The protective handwear according to claim 1, further comprising:

a cover layer affixed to a side of said adsorption layer that faces the hand of the wearer when said protective handwear is being worn and faces away from said membrane.

9. The protective handwear according to claim 8, wherein said cover layer is an air-permeable textile material, selected from the group consisting of: a woven fabric; a hand-knitted fabric; a machine-knitted fabric; a layered fabric; a non-woven fabric; and a bonded fabric; and wherein said cover layer is abrasion-resistant and has a weight per unit area of 5-150 g/m$^2$.

10. The protective handwear according to claim 1, wherein said adhesive is applied discontinuously such that it covers only a maximum of 30% of a side of said membrane that faces away from a hand of a wearer when said handwear is being worn.

11. The protective handwear according to claim 1, wherein said membrane and said adsorption layer are bonded together by an adhesive.

12. The protective handwear according to claim 11, wherein said adhesive is applied discontinuously, and at least 50% of a side of said membrane that faces a hand of a wearer when said protective handwear is being worn and faces away from said outer support layer, is covered with said adsorbent material of said adsorption layer.

13. The protective handwear according to claim 11, wherein said membrane is self-adhesive, and is said adhesive for bonding said membrane and said adsorption layer.

14. The protective handwear according to claim 1, wherein all of said outer support layer, said barrier layer, and said second support layer form a composite.

15. The protective handwear according to claim 1, which is a five-fingered glove.

16. The protective handwear according to claim 1, wherein said outer support layer is leather or an air-permeable textile material selected from the group consisting of: a woven fabric; a hand-knitted fabric; a machine-knitted fabric; a layered fabric; a bonded fabric; and a nonwoven fabric.

17. The protective handwear according to claim 1, wherein said outer support layer is leather.

18. The protective handwear according to claim 1, wherein said outer support layer is rendered at least one of oleophobic and hydrophobic by impregnation, respectively, with an oleophobic and a hydrophobic substance and said outer support layer has a weight per unit area of 50-300 g/m$^2$.

19. The protective handwear according to claim 1, wherein when said outer support layer is an air permeable textile cloth having a weight per unit area of 75-250g/m$^2$.

20. The protective handwear according to claim 1, wherein said membrane is continuous, and is one of closed and microporous, said membrane having a thickness of 1-500 μm, a water vapor permeability, at 25° C., and at a thickness of 50 μm, of at least 12.5 L/m$^2$ per 24 hours; and wherein said protective handwear has a water vapor permeability of at least 10 L/m$^2$ per 24 hours, at 25° C. and at a membrane thickness of 50 μm.

21. The protective handwear according to claim 1, wherein, under steady-state conditions at 35° C. and at a thickness of 50 μm, said membrane has a water-vapor resistance $R_{et}$ of a maximum of 25 (m$^2$·pascal)/watt; and said protective handwear has a water vapor resistance $R_{et}$ of a maximum of 30 (m$^2$·pascal)/watt.

22. The protective handwear according to claim 1, wherein said membrane has a water swelling or water absorption capacity that is a maximum of 35%, based on the weight of the membrane, and wherein said membrane is at least partially impermeable to liquids and aerosols.

23. The protective handwear according to claim 1, wherein said membrane is essentially devoid of strongly hydrophilic groups.

24. The protective handwear according to claim 1, wherein said membrane is one of a plastic and a polymer.

25. The protective handwear according to claim 1, wherein said membrane is selected from the group consisting of: polyurethanes; polyether amides; polyester amides; polytetrafluoroethylenes; cellulose-based polymers; and derivatives of the foregoing.

26. The protective handwear according to claim 1, wherein said membrane comprises a material obtained as the reaction product of the reaction of an isocyanate with an isocyanate-reactive cross-linking agent.

27. The protective handwear according to claim 1, wherein said membrane is comprised of one of a polyurethane and a polytetrafluoroethylene.

28. The protective handwear according to claim 1, wherein said membrane is formed as one selected from the group consisting of: a multilayer laminate and a multilayer composite.

29. The protective handwear according to claim 28, wherein said membrane comprises: a core layer, and two outer layers bonded to said core layer; and wherein said core layer and each of said two outer layers each has a thickness of 1-100 μm.

30. The protective handwear according to claim 29, wherein said two outer layers are bonded to said core layer such that there is an outer layer on either side of said core layer.

31. The protective handwear according to claim 29, wherein said core layer comprises a cellulose-based polymer; and said two outer layers are comprised of one selected from the group consisting of: a polyurethane, a polyether amide, and a polyester amide.

32. The protective handwear according to claim 1, wherein said membrane comprises two pieces of material, each of said two pieces of material having the shape of a hand with five fingers, such that one of said two pieces of material covers a ventral (palm) side of a hand, and said other piece of material covers a dorsal (back of hand) side of the hand, with said two pieces of material being joined together along an outer contour of said pieces of material, by one of adhesive bonding and heat sealing, to form a sealed structure.

33. The protective handwear according to claim 1, wherein said adsorption layer is discontinuously formed by discrete particles of adsorbent material.

34. The protective handwear according to claim 33, wherein said discrete particles are activated carbon particles having a mean diameter at least 0.1 mm and less than 1.0 mm, which are applied to said membrane in an amount of 5-500 $g/m^2$, have a specific surface (BET) of 800 to 1,500 $m^2/g$; and a bursting pressure of individual ones of said activated carbon particles of at least 5 newtons.

35. The protective handwear according to claim 1, wherein said adsorption layer comprises activated carbon fibers in the form of an activated carbon cloth, selected from the group consisting of: an activated carbon woven fabric; an activated carbon knitted fabric; an activated carbon layered fabric; an activated carbon bonded fabric; and an activated carbon non-woven fabric, said selected activated carbon cloth having a weight per unit area of 20-200 $g/m^2$.

36. The protective handwear according to claim 35, wherein said activated carbon cloth is made from one of activated carbonized cellulose and activated carbonized acrylonitriles.

37. The protective handwear according to claim 1, wherein said adsorption layer is impregnated with at least one catalyst selected from the group consisting of enzymes and metal ions, wherein said metal ions are ions of a metal selected from the group consisting of: copper, silver, cadmium, platinum, palladium, zinc, and mercury; and wherein said catalyst is present in an amount 0.05 to 12wt.%, based on the weight of said adsorption layer.

38. The protective handwear according to claim 1, wherein said adsorption layer is at least 50% accessible to said toxic chemical agents to be adsorbed.

39. The protective handwear according to claim 1, wherein said membrane has a barrier effect against toxic chemical agents up to a maximum of 4 $\mu g/cm^2$ per 24hours, at a membrane thickness of 50 μm.

40. Protective handwear with a protective function against toxic chemical agents, said protective handwear having a multilayer construction, at least a part of which is breathable in that it is selectively able to allow passage therethrough of certain substances, said protective handwear comprising:

a.) an outer support layer, which is farthest from a hand of a wearer when the protective handwear is being worn;

b.) an inner barrier layer, which is at least partially resistant to the passage of toxic chemical agents therethrough, and which is arranged adjacent to said outer support layer, such that said inner barrier layer is nearest to the hand of the wearer when the protective handwear is being worn;

said inner barrier layer comprising:

i.) an adsorption layer, containing an adsorbent material, capable of adsorbing toxic chemical agents; and ii.) a membrane, which is at least partially impermeable to the passage of air, liquid water, and toxic chemical agents therethrough, and which is at least partially permeable to the passage of water vapor therethrough wherein said membrane is arranged between said support layer and said adsorption layer so that a side of said membrane facing the hand of the wearer is covered by said adsorption layer and wherein said protective handwear has a barrier effect against toxic chemical agents up to a maximum of 4 $\mu g/cm^2$ per 24 hours at a membrane thickness of 50 μm; and c.) a second support layer arranged between said membrane and said outer support layer, said second support layer comprising a textile material having a lower weight per unit area than said outer support layer and being joined to said membrane by a discontinuously applied adhesive so that said membrane is supported and stabilized by said second support layer.

41. Protective handwear with a protective function against toxic chemical agents, said protective handwear having a multilayer construction, at least a part of which is breathable in that it is selectively able to allow passage therethrough of certain substances, said protective handwear comprising:

a.) an outer support layer, which is farthest from a hand of a wearer when the protective handwear is being worn;

b.) an inner barrier layer, which is at least partially resistant to the passage of toxic chemical agents therethrough, and which is arranged adjacent to said outer support layer, such that said inner barrier layer is nearest to the hand of the wearer when the protective handwear is being worn;

said inner barrier layer comprising:

i.) an adsorption layer, containing an adsorbent material, capable of adsorbing toxic chemical agents; and ii.) a membrane, which is at least partially impermeable to the passage of air, liquid water, and toxic chemical agents therethrough, and which is at least partially permeable to the passage of water vapor therethrough, wherein said membrane is arranged between said support layer and said adsorption layer so that a side of said membrane facing the hand of the wearer is covered by said adsorption layer and wherein said protective handwear has a water vapor permeability of at least 10 $L/m^2$ per 24 hours at 25° C. and at a membrane thickness of 50 μm; and c.) a second support layer arranged between said membrane and said outer support layer, said second support layer comprising a textile material having a lower weight per unit area than said outer support layer and being joined to said membrane by a discontinuously applied adhesive so that said membrane is supported and stabilized by said second support layer.

42. Protective handwear with a protective function against toxic chemical agents, said protective handwear having a multilayer construction, at least a part of which is breathable in that it is selectively able to allow passage therethrough of certain substances, said protective handwear comprising:

a.) an outer support layer, which is farthest from a hand of a wearer when the protective handwear is being worn;

b.) an inner barrier layer, which is at least partially resistant to the passage of toxic chemical agents therethrough, and which is arranged adjacent to said outer support layer, such that said inner barrier layer is nearest to the hand of the wearer when the protective handwear is being worn;

said inner barrier layer comprising:

i.) an adsorption layer, containing an adsorbent material, capable of adsorbing toxic chemical agents; and ii.) a membrane, which is at least partially impermeable to the passage of air, liquid water, and toxic chemical agents therethrough, and which is at least partially permeable to the passage of water vapor therethrough, wherein said membrane is arranged between said support layer and said adsorption layer so that a side of said membrane facing the hand of the wearer is covered by said adsorption layer and wherein said protective handwear has a water vapor resistance $R_{et}$ of a maximum of 30 ($m^2$·pascal)/watt under steady-state conditions at 35° C. and a membrane thickness of 50 μm; and c.) a second support layer arranged between said membrane and said outer support layer, said second support layer comprising a textile material having a lower weight per unit area than said outer support layer and being joined to said membrane by a discontinuously applied adhesive so that said membrane is supported and stabilized by said second support layer.

* * * * *